United States Patent [19]

Gage

[11] Patent Number: 5,018,935

[45] Date of Patent: May 28, 1991

[54] AUTOMATIC PRESSURE RELIEF SYSTEM FOR A HYDRAULIC MOTOR

[75] Inventor: Douglas M. Gage, Dubuque, Iowa

[73] Assignee: Deere & Company, Moline, Ill.

[21] Appl. No.: 434,941

[22] Filed: Nov. 9, 1989

[51] Int. Cl.[5] ..... B66C 1/42

[52] U.S. Cl. ..... 414/729; 60/493; 91/420; 137/106

[58] Field of Search ..... 414/729; 294/86.41, 294/88; 60/493; 91/420; 137/106

[56] References Cited

U.S. PATENT DOCUMENTS 3,933,167 1/1976 Byers, Jr. ..... 137/106
4,005,894 2/1977 Tucek ..... 294/88
4,586,332 5/1986 Schexnayder ..... 60/493 X
4,712,377 12/1987 Yoshida et al. ..... 60/493 X

*Attorney, Agent, or Firm*—Kevin J. Moriarty
*Primary Examiner*—F. J. Bartuska
*Assistant Examiner*—Donald W. Underwood

[57] ABSTRACT

A check valve assembly having first and second check valves and an unseating spool is positioned between a control valve and a rotary motor. The unseating spool is elongated so that it continually contacts the valve elements of the check valves. The check valve hydraulically coupled to the higher pressure supply/return line drives the unseating spool against the valve element of the other check valve opening it and connecting the associated supply/return line having lower hydraulic pressure to reservoir through the direction control valve.

33 Claims, 3 Drawing Sheets

FIG. 1
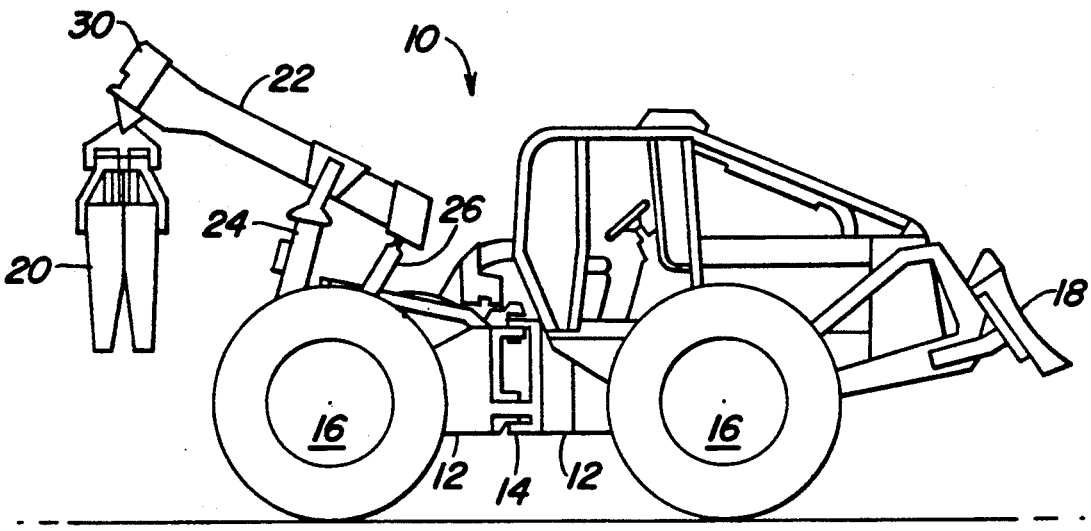
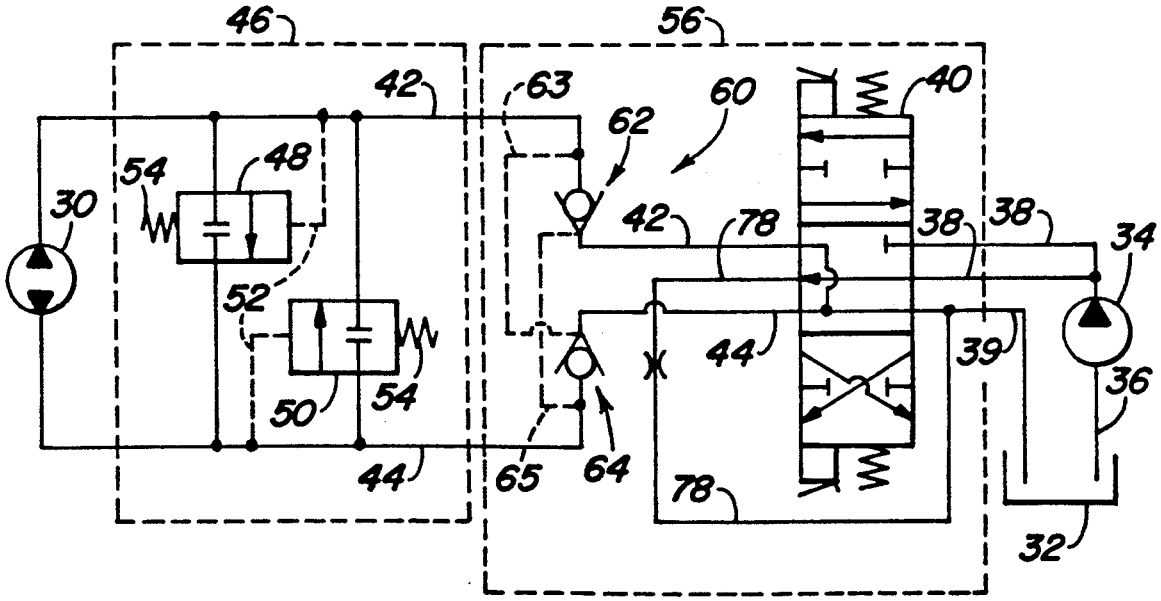
FIG. 2

AUTOMATIC PRESSURE RELIEF SYSTEM FOR A HYDRAULIC MOTOR

BACKGROUND OF THE INVENTION

1. Field of the Invention

The invention is directed to a hydraulic circuit for directing hydraulic fluid to a rotary hydraulic motor. A check valve assembly is positioned between the motor and the control valve for coupling the low pressure supply/return line to reservoir when a direction control valve is in a neutral or checked position.

2. Description of the Prior Art

Hydraulic systems for driving rotary hydraulic motors are well known. In a typical circuit, hydraulic fluid is drawn from a reservoir by a pump and directed to a four-way three-position direction control valve. The direction control valve directs pressurized fluid through one of the supply/return lines to the motor and removes the exhausted fluid from the other supply/-return line to the reservoir.

To protect the motor and other hydraulic components, a crossover relief valve system maybe located between the supply/return lines. The crossover relief valve system typically comprises two spring biassed hydraulic pressure relief valves which direct hydraulic fluid from the high pressure supply/return line to the low pressure supply/return line.

When the direction control valve is in a neutral or checked position, hydraulic pressure may build up in the supply/return lines as hydraulic fluid leaks across the direction control valve to the supply/return lines. As the pressure relief in each of these lines dumps to the other line pressure builds up in both lines, overpressurizing the seals of the motor. As such hydraulic fluid may leak through the seals of the motor. Many motors are provided with case drains and case drain lines for directing leaking hydraulic fluid back to the reservoir.

Grapple skidders are forestry work vehicles used to haul logs in rugged terrain. The grapple is located at the rear of the skidder and is used to grab logs. Typically a rotary hydraulic motor is located on top of the log arch for rotating the grapple. This motor is subjected to various loads when the skidder is skidding a log. More specifically, when turning the skidder, the log lags in the turn thereby twisting the grapple and rotating the motor. By twisting the grapple, the logs drive the motor as a pump possibly overloading the crossover relief valves and causing fluid to leak through the seals of the rotary motor. As such the motor must be equipped with a case drain and case drain line.

SUMMARY

It is one of the objects of the present invention to provide a rotary hydraulic motor that is not provided with a case drain and case drain line.

It is another object of the present invention to provide a hydraulic circuit for a rotary motor that may more easily be flushed.

It is a feature of the present invention to provide a simple check valve assembly to accomplish the above stated objects.

It is another feature of the present invention to maintain low hydraulic pressure on one side of the motor at all times, thereby keeping maximum pressure on the high pressure side equal to the cross over relief settings.

It is another feature of the present invention that high pressure leakage past the control spool is routed to sump rather than the work ports thereby eliminating power drift.

The invention comprises a hydraulic system for driving a rotary hydraulic motor. A pump directs hydraulic fluid from a reservoir to a four-way three-position direction control valve which controls the flow of fluid to a rotary hydraulic motor. The two supply/return lines directing fluid from the direction control valve to the motor are provided with a crossover relief valve assembly. A check valve assembly is hydraulically coupled between the two supply/return lines and comprises two check valves and an unseating spool. The unseating spool is positioned between the two check valves and always has the check valve on the low pressure supply/return line open. In this way the low pressure supply/return line is always coupled to reservoir.

The check valve assembly is a modified lockout section of a four-way three-position direction control valve. More specifically, the unseating spool has been elongated so that it always contacts one of the valve elements of the two check valves. In addition the work ports downstream of the check valves have been modified so that fluid pressure from these ports is directed to the downstream side of the valve element. In this way the high pressure supply return line drives the valve element on the high pressure side towards the valve element on the low pressure side shifting the unseating spool and opening the low pressure side check valve.

BRIEF DESCRIPTION OF THE DRAWINGS

FIG. 1 is a side view of a grapple skidder.

FIG. 2 is a hydraulic schematic of the present invention in an open center hydraulic circuit.

DETAILED DESCRIPTION

Figure 3:
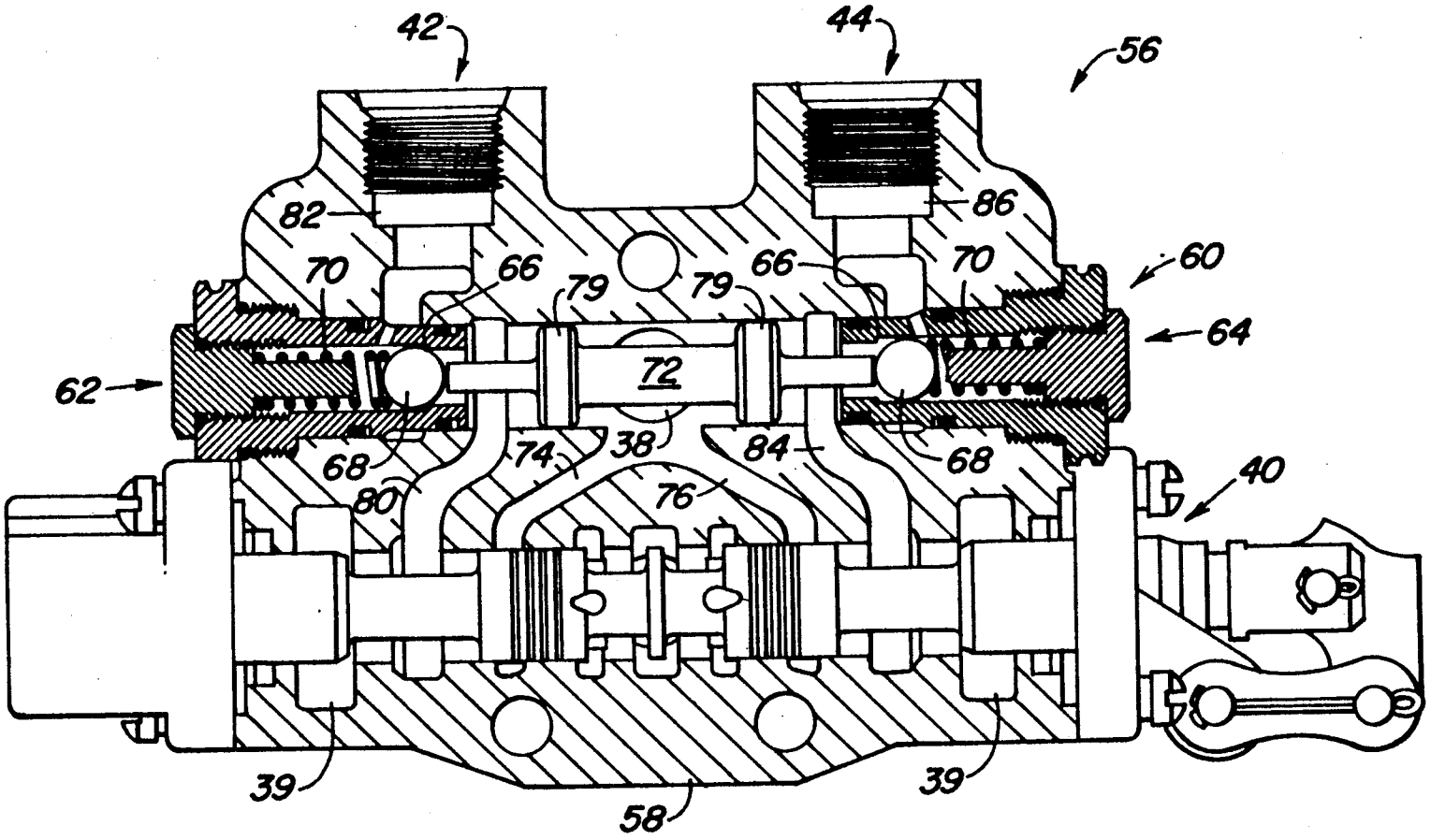
FIG. 3 is a cross section of the check valve assembly of the present invention.

FIG. 1 illustrates a grapple skidder for which this invention is particularly well suited. However this invention can be used in any hydraulic system driving a rotary hydraulic motor.

Grapple skidder 10 comprises an articulated frame 12 that is articulated about vertical pivots 14. The skidder is provided with ground engaging means 16 comprising wheels which support and propel the skidder. A dozer blade 18 extends from and is operatively coupled to the skidder. Grapple 20 is manipulated by grapple linkage comprising boom 22 and grapple arch 24. Grapple 20 is attached to boom 22 located at the rear of the skidder. The boom is mounted on a grapple arch 24 and is manipulated relative to the grapple arch by hydraulic actuators 26. The grapple arch is manipulated relative to the skidder by another hydraulic actuator, not shown. The tongs of the grapple itself are opened and closed by a hydraulic actuator located inside the grapple. In the illustrated embodiment rotary hydraulic motor 30 is located on top of the boom and is used to rotate grapple 20, however, the motor could be located inside the grapple head.

An open center hydraulic system for driving motor 30 is illustrated in FIG. 2. Reservoir or sump 32 supplies fluid to fixed displacement pump 34 by supply line 36. Hydraulic fluid from pump 34 is directed through supply lines 38 to direction control valve 40. Direction control valve 40 is a four-way three-position valve that directs fluid to and receives fluid from first and second supply/return lines 42 and 44. These supply/return lines are hydraulically coupled to pump 30. Exhausted fluid from the pump is returned through the supply/return lines and direction control valve to return line 39.

Crossover relief valve assembly 46 is hydraulically coupled between the first and second supply/return lines. The crossover relief valve assembly is relatively conventional, in that it is provided with first and second spring biassed pressure relief valves 48 and 50, respectively. By way of example, the operation of first pressure relief valve 48 will be discussed in more detail as it operates identically to that of the second pressure relief valve 50. First pressure relief valve 48 is provided with fluid pressure sensing line 52 that is hydraulically coupled to first supply/return line 42 and spring 54 for biassing valve 48 into a checked condition. Valve 48 hydraulically couples first supply/return line 42 to second supply/return line 44 when pressure in first supply/return line 42 exceeds the spring force of spring 54.

FIG. 3 illustrates the structure of the direction control and check valve assembly 56. This structure comprises a valve casing 58 that houses direction control valve 40 and check valve assembly 60. The check valve assembly comprises first and second check valves 62 and 64, respectively. Each of the check valves is provided with a valve seat 66, a valve element 68 and a biassing spring 70. Although the valve elements are illustrated as being spherical, other configurations may be used.

The check valves are biased to normally block the flow of fluid from a supply/return line directly to the reservoir. However an unseating spool 72 is located between the check valves in contact with the valve elements. The unseating spool is an elongated spool which is always unseating or opening the low pressure side check valve.

Fluid enters the valve casing through supply line 38 past unseating spool 72. The fluid is divided into two passages 74 and 76 that direct the fluid to the direction control spool. As this is an open center valve, fluid must continually pass through the valve. To accomplish this restricted valve exhaust line 78 directs the fluid back to reservoir. As such, line 78 forms a bypass line for returning fluid to sump bypassing direction control valve 40. Valve exhaust line 78 is not shown in FIG. 3 in that it is located opposite supply line 38.

When driving motor 30 direction control valve 40 is shifted right or left thereby selectively directing pressurized fluid to the motor. When this happens the check valve on the supply/return line receiving pressurized fluid is unseated and the unseating spool is driven in the other direction by fluid pressure acting on pistons 79. The shifted unseating spool unseats the other check valve thereby providing a return path to reservoir.

In the neutral or checked position illustrated in FIG. 3, fluid passes from supply line 38 past unseating spool 72 to restricted valve exhaust line 78. Some pressurized fluid may leak past the seals and into one or both of the supply/return lines. In FIG. 3, supply/return line 42 has the highest pressure thereby driving the valve element 68 towards its valve seat 66 closing check valve 62. The high pressure valve element also drives the unseating spool towards the other valve element. The low pressure check valve 64 becomes unseated by the unseating spool resulting in supply/return line 44 being coupled to reservoir through direction control valve 40. In the hydraulic schematics of FIGS. 2 and 4, this mechanical unseating action is illustrated by dashed lines 63 and 65.

If the low pressure side later becomes the high pressure side, unseating spool 72 is shifted closing the new high pressure check valve 64 and opening the new low pressure check valve 62 to reservoir. Such a reversal can be caused by skidding a log around a corner resulting in a twisting action on the grapple and grapple motor. It is important to note that although one of the check valves is always opened to sump, the other check valve is always closed when the direction control valve is in the neutral or checked position. As such the high pressure side is always blocked thereby braking the rotating mechanism when external loads are applied.

The valve structure itself is a modified Gersen V-20-LO valve, marketed by the Dana Corporation. In modifying the valve, the unseating spool is elongated so that one valve element is always unseated. In addition, the ports are modified so that fluid is applied to the downstream side of the valve element.

The first and second supply/return lines comprise first and second hydraulic passages in valve casing 58. First supply/return passage 42 is divided into a first upstream portion 80 and a first downstream portion 82 by first check valve 62. Similarly, second supply/return passage 44 is divided into second upstream portion 84 and a second downstream portion 86 by second check valve 64. As illustrated in FIG. 3, the first and second downstream portions 82 and 86 of first and second supply/return passages are hydraulically coupled to the downstream side of the corresponding valve element. With this arrangement of hydraulic pressure is applied to the downstream side of the valve element driving the unseating spool towards the other check valve.

Figure 4:
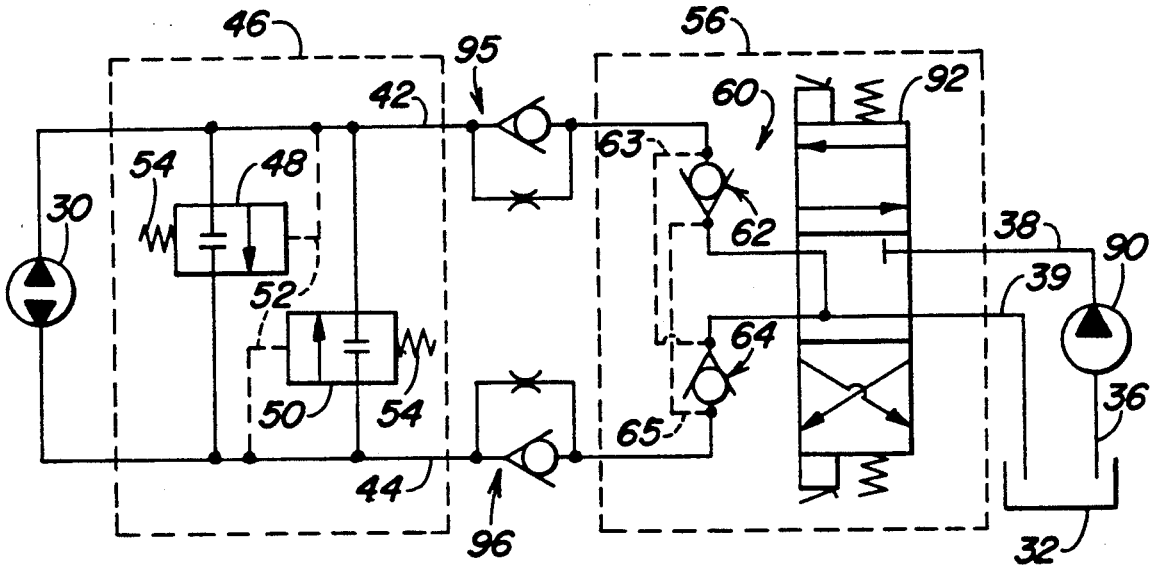
FIG. 4 is a hydraulic schematic of the present invention in a closed center hydraulic circuit.

In the embodiment illustrated in FIG. 4, the check valve assembly is mounted in a closed center hydraulic circuit with a variable displacement pump 90. Direction control and check valve assembly 56 used in FIG. 4 is identical to the valve assembly illustrated in FIG. 3 except that an end section has been substituted blocking open center passage 78. The hydraulic schematic for direction control valve 92 has been appropriately modified.

To maintain regulated adequate pressure at motor 30 valve assemblies 95 and 96 may be fluidly located between direction control and check valve assembly 56 and cross over relief valve assembly 46, on supply/-return lines 42 and 44. Fluid directed to the motor is forced through the orifice structure of valve assemblies 95 and 96 whereas exhaust fluid from the motor passes through the orifice and the check valve structure.

It may be desirable to use valve assemblies 95 and 96 in the open center system illustrated in FIG. 2. However, as open center systems are generally high volume low pressure systems, an open center system may require additional pressure relief valves to dump fluid to sump.

The present invention maybe more valuable in a closed center hydraulic system which tend to be low volume high pressure systems. This is because the higher pressure of closed center hydraulic systems require higher crossover relief settings. In addition, with higher pressure systems there is greater leakage past the direction control valve. With the present system, this leakage is routed to sump eliminating power drift of the motor.

In prior art hydraulic systems, it was difficult if not impossible to flush the case drain and case drain line.

Flushing the case drain and case drain line by overpressurizing the system would damage the motor seals. The present hydraulic system eliminates the case drain and case drain line. The remaining hydraulic lines are flushed during normal operations.

The invention should not be limited by the above described embodiment, but should be limited solely by the claims that follow.

I claim:

1. A hydraulic system comprising:

a reservoir for holding hydraulic fluid;

a source of pressurized hydraulic fluid is hydraulically coupled to the reservoir, the source of pressurized hydraulic fluid takes fluid from the reservoir and pressurizes the fluid;

a control valve is hydraulically coupled to the source of pressurized hydraulic fluid, the control valve controls the flow of hydraulic fluid from the source of pressurized hydraulic fluid, the control valve has a neutral position wherein flow from the source of pressurized hydraulic fluid is checked;

first and second supply/return lines are hydraulically coupled to the control valve for directing pressurized hydraulic fluid from the control valve and exhausted hydraulic fluid to the control valve;

a hydraulic motor is hydraulically coupled to the first and second supply/return lines, the hydraulic motor is driven by the pressurized hydraulic fluid supplied through the control valve by the source of pressurized hydraulic fluid; and means for automatically hydraulically coupling the supply/return line having a lower hydraulic pressure than the other supply/return line to reservoir when the control valve is in the neutral position.

2. A hydraulic system as defined by claim 1 wherein the means comprises a check valve assembly.

3. A hydraulic system as defined by claim 2 wherein the check valve assembly is hydraulically positioned between the control valve and the hydraulic motor.

4. A hydraulic system as defined by claim 3 wherein fluid from a supply/return line having a lower hydraulic pressure is hydraulically coupled to the control valve for return to the reservoir.

5. A hydraulic system as defined by claim 4 wherein the check valve assembly comprises first and second check valves, the first check valve when seated prevents the flow of hydraulic fluid from the first supply/-return line to the control valve, the second check valve when seated prevents the flow of hydraulic fluid from the second supply/return line to the control valve.

6. A hydraulic system as defined by claim 5 wherein the valve assembly further comprises an unseating spool located between the first and second check valves for unseating one of the check valves at all times.

7. A hydraulic system as defined by claim 6 wherein the control valve is an open center valve.

8. A hydraulic system as defined by claim 7 wherein the source of pressurized hydraulic fluid is an fixed displacement pump.

9. A hydraulic system as defined by claim 6 wherein the control valve is a closed center valve.

10. A hydraulic system as defined by claim 9 wherein the source of pressurized hydraulic fluid is a variable displacement pump.

11. A hydraulic system as defined by claim 6 further comprising a crossover relief assembly that is hydraulically coupled between the first and second supply/-return lines.

12. A work vehicle for performing a work operation, comprising:

a support structure;

ground engaging means coupled to the support structure for supporting and propelling the support structure;

a working implement mounted to the support structure for performing a work operation;

a rotary hydraulic motor coupled to the supporting structure and the work implement for manipulating the work implement;

a reservoir for holding hydraulic fluid;

a source of pressurized hydraulic fluid is hydraulically coupled to the reservoir, the source of pressurized hydraulic fluid takes fluid from the reservoir and pressurizes the fluid;

a control valve is hydraulically coupled to the source of pressurized hydraulic fluid, the control valve controls the flow of hydraulic fluid from the source of pressurized hydraulic fluid, the control valve having a neutral position wherein flow from the source of pressurized fluid is checked;

first and second supply/return lines are hydraulically coupled to the control valve for directing pressurized hydraulic fluid from the control valve to the rotary hydraulic motor, and exhausted hydraulic fluid from the rotary hydraulic motor to the control valve; and means for automatically hydraulically coupling the supply/return line having a lower hydraulic pressure than the other supply/return line to reservoir when the control valve is in the neutral position.

13. A work vehicle as defined by claim 12 wherein the means comprises a check valve assembly.

14. A work vehicle as defined by claim 13 wherein the check valve assembly is hydraulically positioned between the control valve and the hydraulic motor.

15. A work vehicle as defined by claim 9 wherein fluid from a supply/return line having a lower hydraulic pressure is hydraulically coupled to the control valve for return to the reservoir.

16. A work vehicle as defined by claim 15 wherein the check valve assembly comprises first and second check valves, the first check valve when seated prevents the flow of hydraulic fluid from the first supply/-return line to the control valve, the second check valve when seated prevents the flow of hydraulic fluid from the second supply/return line to the control valve.

17. A work vehicle as defined by claim 16 wherein the valve assembly further comprises an unseating spool located between the first and second check valves for unseating one of the check valves at all times.

18. A work vehicle as defined by claim 17 wherein the control valve is an open center valve.

19. A work vehicle as defined by claim 18 wherein the source of pressurized hydraulic fluid is an fixed displacement pump.

20. A work vehicle as defined by claim 17 wherein the control valve is a closed center valve.

21. A work vehicle as defined by claim 20 wherein the source of pressurized fluid is a variable displacement pump.

22. A work vehicle as defined by claim 17 further comprising a crossover relief assembly that is hydraulically coupled between the first and second supply/-return lines.

23. A grapple skidder for skidding logs comprising:

a support structure;

ground engaging means coupled to the support structure for supporting and propelling the support structure;

a grapple linkage extending from the support structure;

a grapple coupled to the grapple linkage;

a rotary hydraulic motor coupled to the grapple linkage for rotating the grapple;

a reservoir for holding hydraulic fluid;

a source of pressurized hydraulic fluid is hydraulically coupled to the reservoir, the source of pressurized hydraulic fluid takes fluid from the reservoir and pressurizes the fluid;

a control valve is hydraulically coupled to the source of pressurized hydraulic fluid, the control valve controls the flow of hydraulic fluid from the source of pressurized hydraulic fluid, the control valve having a neutral position wherein flow from the source of pressurized fluid is checked;

first and second supply/return lines are hydraulically coupled to the control valve for directing pressurized hydraulic fluid from the control valve to the rotary hydraulic motor and exhausted hydraulic fluid from the rotary hydraulic motor to the control valve, and means for automatically hydraulically coupling the supply/return line having a lower hydraulic pressure than the other supply/return line to reservoir when the control valve is in the neutral position.

24. A grapple skidder as defined by claim 23 wherein the means comprises a check valve assembly.

25. A grapple skidder as defined by claim 24 wherein the check valve assembly is hydraulically positioned between the control valve and the rotary hydraulic motor.

26. A grapple skidder as defined by claim 25 wherein fluid from a supply/return line having a lower hydraulic pressure is hydraulically coupled to the control valve for return to the reservoir.

27. A grapple skidder as defined by claim 26 wherein the check valve assembly comprises first and second check valves, the first check valve when seated prevents the flow of hydraulic fluid from the first supply/-return line to the control valve, the second check valve when seated prevents the flow of hydraulic fluid from the second supply/return line to the control valve.

28. A grapple skidder as defined by claim 27 wherein the valve assembly further comprises an unseating spool located between the first and second check valves for unseating one of the check valves at all times.

29. A grapple skidder as defined by claim 28 wherein the control valve is an open center valve.

30. A grapple skidder as defined by claim 29 wherein the source of pressurized hydraulic fluid is a fixed displacement pump.

31. A grapple skidder as defined by claim 28 wherein the control valve is a closed center valve.

32. A grapple skidder as defined by claim 31 wherein the source of pressurized hydraulic fluid is a variable displacement pump.

33. A grapple skidder as defined by claim 28 further comprising a crossover relief assembly that is hydraulically coupled between the first and second supply/-return lines.

* * * * *